United States Patent [19]

Augustin

[11] Patent Number: 4,860,566

[45] Date of Patent: Aug. 29, 1989

[54] METHOD AND APPARATUS FOR STRAIGHTENING A WORKPIECE

[75] Inventor: Karl-Heinz Augustin, Wedemark, Fed. Rep. of Germany

[73] Assignee: Hans-Georg Augustin, Fed. Rep. of Germany

[21] Appl. No.: 141,422

[22] Filed: Jan. 7, 1988

[30] Foreign Application Priority Data

Jan. 17, 1987 [DE] Fed. Rep. of Germany ..... 3701223

[51] Int. Cl.[4] ..... B21H 7/00

[52] U.S. Cl. ..... 72/110; 72/30

[58] Field of Search ..... 72/30, 107, 110

[56] References Cited

U.S. PATENT DOCUMENTS 4,416,130 11/1983 Judge, Jr. ..... 72/76

4,561,276 12/1985 Berstein ..... 72/110

FOREIGN PATENT DOCUMENTS 101228 6/1984 Japan ..... 72/110

957805 5/1964 United Kingdom ..... 72/110

*Primary Examiner*—Lowell A. Larson

[57] ABSTRACT

The invention relates to a method and an apparatus for straightening a workpiece, especially a crankshaft, with a theoretical axis and at least one fillet running circularly about this axis, by exerting a pressure on at least one preselected section of the wall defining the fillet, with a tool that can be moved transversely of the axis and laid into the fillet. To reduce the great straightening forces to be applied in the use of known methods and apparatus, the straightening is performed according to the invention by cold-rolling the fillet walls and with the aid of a modified hard-rolling device, the control systems are provided with measuring means for determining the deviations from true running of the main journals of the crankshaft and actuators for the adjustment of the forces applied by the pressure rollers to the fillet walls according to the particular rotary angular position of the crankshaft to values intended for the straightening of the main journals.

11 Claims, 4 Drawing Sheets

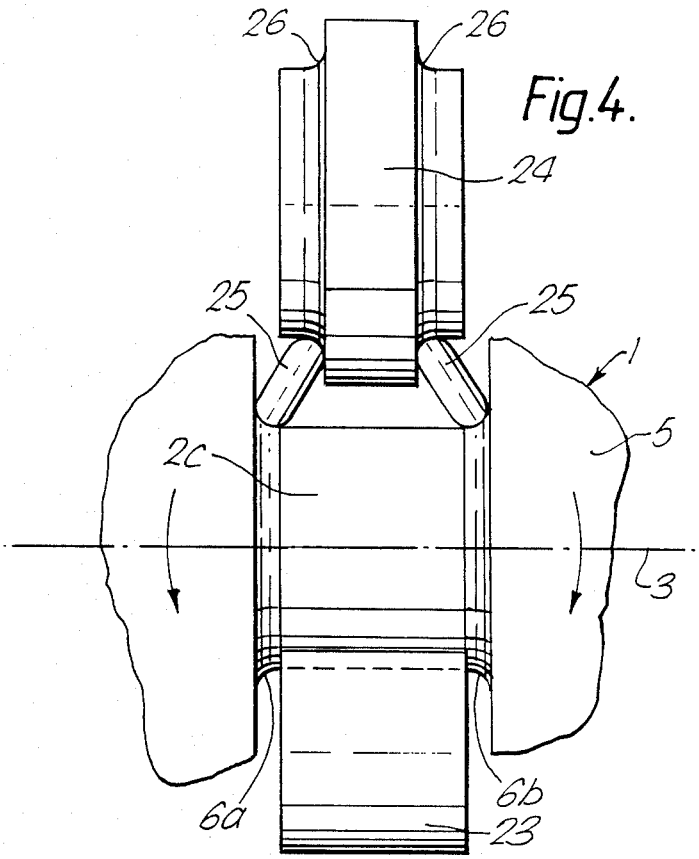
Fig.4.
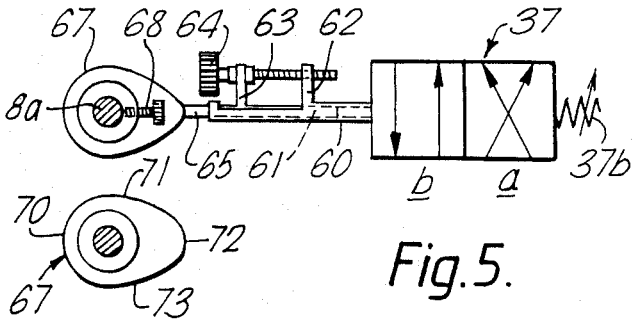
Fig.5.
Fig.6.
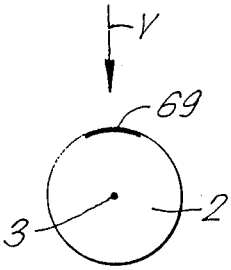

METHOD AND APPARATUS FOR STRAIGHTENING A WORKPIECE

BACKGROUND OF THE INVENTION

The invention relates to a method and an apparatus for straightening a workpiece, especially a crankshaft with a theoretical axis and at least on fillet running circularly about the axis, by exerting pressure with a tool that can move transversely of the axis and can be laid into the fillet, against at least one preselected section of the wall defining the fillet.

The fatigue strength of workpiece having circular rotating fillets, e.g., crankshafts, axle journals, turned-down shafts, or the like, is adversely affected particularly by the reduction of strength due to the shape of the material in the area of these fillets. It is therefore known to treat such workpieces by a method to be referred to hereinafter as "hard-rolling" and consists in pressing solid rollers with hydraulic jacks against the fillets, especially against walls defining curved fillets (DE-PS No. 30 37 688). This on the one hand increases the strength of the materials in the outer layers, and on the other hand produces useful compressive tensions in the zones adjacent the fillets, which manifest themselves in the later use of the workpieces by a considerably improved fatigue strength. These inherent compressive tensions produced in the material, however, lead inevitably to distortions in the workpieces, and the direction and amount of the distortions depend largely on the history of the workpieces. In a crankshaft these distortions result principally in misalignments of the main bearings and crankpins and hence in a distortion or "wobble" of the entire crankshaft, because in hard-rolling, inevitable deflections of the crank cheeks from the perpendicular position with respect to the crankpin axes occur. The deviations from the true running of the crankshaft with respect to its theoretical axis of rotation which this causes must be remedied by subsequent straightening of the crankshaft regardless of whether the flexing of the crankshaft cheeks by the hard-rolling is kept within defined tolerances or not. The same goes for the production of axle journals and other such workpieces having fillets, in which the distortions caused by hard-rolling also have to be remedied afterwards.

The straightening of such workpieces by bending has proven unsuitable, since the useful compressive tensions in the area of the fillets are largely relieved by the bending, so that the improved fatigue strength obtained by hard-rolling is lost.

To straighten crankshafts which have been subjected to hard-rolling it is known that this disadvantage is avoided by applying a special tool to appropriate points of the walls defining the fillets, once and with sufficient force (GB-PS No. 1,004,962, DE-PS No. 25 56 971). The directions in which these forces are to be exerted are determined by measuring the crankshaft misalignments created by the hard-rolling. In this case use is made of the knowledge that a force of sufficient magnitude acting over a limited arc of the circumference of the fillet is capable of producing permanent changes of alignment and thereby of reducing the wobbling of the crankshaft. In contrast to bending, in this straightening method only additional compressive tensions are introduced into the material, which do not reduce the fatigue strength. It is disadvantageous, however, that a special work station with an additional tool including the hydraulic press is needed for the straightening process, and great forces of up to 1000 kN must be applied to the crankshaft.

One object of this invention is, therefore, to offer a straightening method in whose application considerably lower forces will suffice. According to a further object of this invention the method shall be such that no additional tools are required. A further object is to propose an apparatus suitable for the practice of this method and for the straightening of crankshafts.

SUMMARY OF THE INVENTION

For the solution of these objects the method mentioned above is characterized in that the straightening is preformed by cold-rolling the fillet wall.

An apparatus for straightening crankshafts having at least one fillet comprises according to this invention: a number, corresponding to the number of main journals and crankpins, of pincer-like mountings borne by two master shafts, which mountings have two jaws apiece, joined together pivotally, for the clamping of an associated main journal or crankpin, while at least in the case of the mountings associated with the main journals the one jaw is provided with at least one supporting roll and the other jaw with at least one pressure roller intended for insertion into a fillet; and one control system for each mounting for the control of the clamping force of the jaws, each control system of the mountings associated with the main journals having a measuring means for determining deviations from true running in the area of the corresponding main journal, and an actuator by means of which the forces exerted by the pressure rollers are adjustable, depending on the particular rotatory angle position of the crankshaft, to values intended for the straightening of the main journals.

Additional advantageous features will be found in the following specification and the appended claims.

The invention offers the advantage that the cold rolling for the purpose of straightening can be performed in a plurality of successive steps and the forces exerted in each of these steps, of up to about 50 kN, are considerably lower than in the case of the use of the known apparatus. Thus it is possible to use for the straightening the same apparatus and tools which are used for the hard-rolling without the danger of overstressing the hard-rolling rollers in the straightening process. This permits the simultaneous hard-rolling and straightening of the workpieces in the same work station, while the workpieces can remain in the clamped-up state during the measurement of the deviations from true running, by measuring these deviations, for example, with measuring apparatus integrated into the hard-rolling apparatus.

BRIEF DESCRIPTION OF THE DRAWING

The invention will be further explained below in conjunction with the appended drawing of an embodiment, wherein:

FIG. 4 is a greatly enlarged diagrammatic partial front view of the apparatus of FIG. 1, FIG. 5 is a variant of a detail of FIG. 3, and FIG. 6 diagrammatically represents the application of the method of the invention to a main bearing journal of a crankshaft.

FIG. 1 shows a workpiece 1 in the form of a crankshaft. It has five main journals 2a to 2e whose axes lie on a theoretical axis 3, here the axis of rotation of the crankshaft, four crankpins 4a to 4d disposed between the main journals 2, and cranks between the crankpins and the main journals 2. At the transitions between the cranks 5 and the main journals and crankpins, 2 and 4 respectively, are the fillets 6a to 6d of circular cross section around the axis 3. Alternatively, the workpiece 1 can consist of axle journals, turned-down shafts or the like, with fillets corresponding to the fillets 6, which as a rule are disposed at the transitions from one cross section to another and serve to increase the fatigue strength in the area of the cross-section transitions, which would be too low without them.

Figure 1:
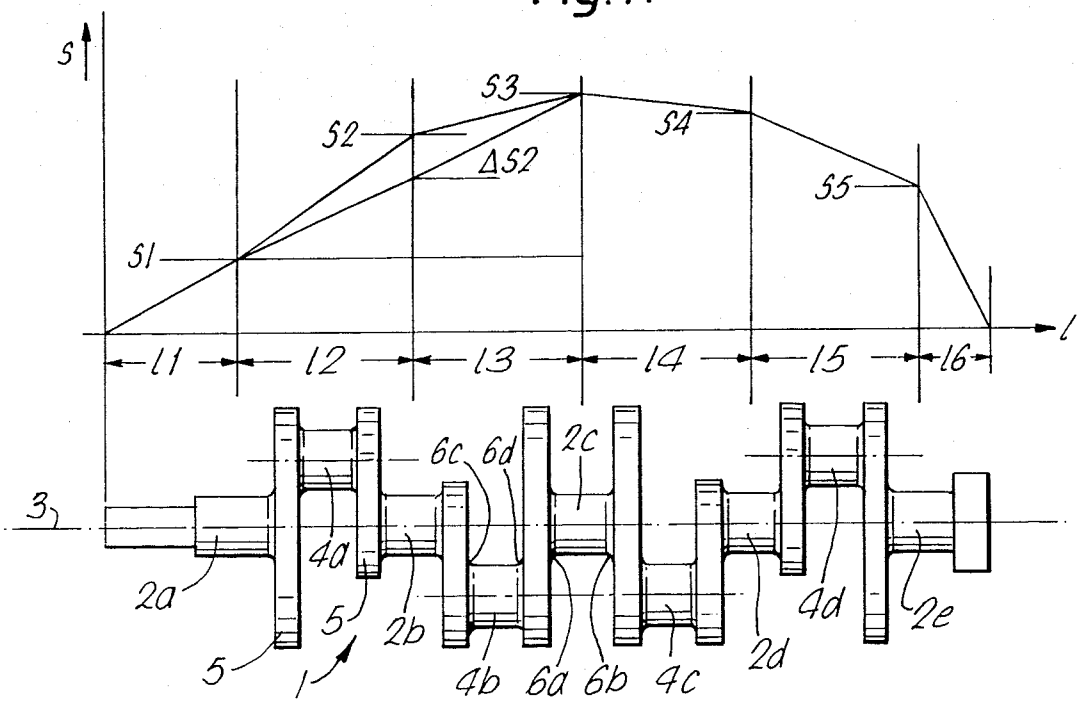
FIG. 1 is a diagram of the wobble of a crankshaft.

Above the workpiece 1 there is represented a wobble diagram in FIG. 1, which indicates in a greatly enlarged scale an arbitrarily assumed curvature of the crankshaft in the plane of the drawing. Along the abscissae are recorded the distances l between the center points of the main journals 2 from the left end of the crankshaft in FIG. 1, while along t he ordinates the deviation S of these centers from the theoretical axis 3 are recorded in a greatly enlarged manner. The deviations S which actually occur are, as a rule, very small, mounting to only a few tenths or hundredths of a millimeter and can be both positive and negative. The wobble diagram of FIG. 1 also relates to a selected angular rotational position of the crankshaft. For other angular positions additional wobble diagrams can be drawn.

From the wobble diagram it is easy to see by what amount and in what direction the crankshaft has to be straightened at each main journal 2 so that all axes of the main journals 2 will lie substantially on one axis, namely the theoretical axis 3. For the main journal 2b in FIG. 1, for example, a correction of ΔS2 perpendicular to the abscissae will be necessary, which is computed by the formula $$\Delta S2 = S2 - S1 - \left(\frac{|S1 - S3|}{l_2 + l_3}\right) \cdot l_2$$

Since it is is very laborious to straighten a crankshaft successively in all possible directions, the following new strategy is proposed according to the invention:

First every deviation from true rotation is divided into two components perpendicular to one another, one of which lies in a plane to be referred to as the primary plane and the other in a plane to be referred to as the secondary plane. If both crankpins 4b to 4c lie according to FIG. 1 in a single plane also containing the theoretical axis 3, this plane will be declared to be the primary plane, while the plane perpendicular thereto will be defined as the secondary plane. If, however, the crankpins 4a to 4d lie, unlike FIG. 1, in at least two different planes, because for example they are offset from one another by 90° in the circumferential direction of the crankshaft, then for every main journal 2b, 2c and 2d that lies according to FIG. 1 between two adjacent crankpins 4, the plane to be declared the primary plane will be the one which contains the axis 3 and the angle bisector between the two planes passing through the axis of each of the adjacent crankpins and the theoretical axis 3. With reference to FIG. 1, the axis of the crankpin 4b and the axis 3, for example, define a first plane, the axis of the crankpin 4c and the axis 3 define a second plane, and the bisector of the angle between these two planes and the axis 3 define a third plate which in this example would be the primary plane for the main journal 2c. The plane perpendicular thereto is the secondary plane for this main journal 2c. On the other hand, the primary plane for the main bearings 2a and 2e and at the ends of the crankshaft, which have only one crankpin 4a and 4d, respectively, adjacent to them, will be based on the axis 3 and the axes of these crankpins 4a and 4d, respectively, while the planes perpendicular thereto will be the secondary planes.

The invention is based to this extent on the knowledge that straightening operations in the secondary planes generally also result in deformation of the crankshaft in the primary planes, while conversely straightening operations in the primary planes produce virtually no repercussions or deformations in the secondary planes. This forms the basis for the straightening strategy according to the invention of first remedying all components of a wobble that lie in the secondary planes and only then remedying all components of the wobble that lie in the primary planes.

For practical application, the plan of operation is the following. After the hard-rolling of the workpieces, first the deviation of each individual main journal is measured. Then the components of the deviations in the principal and secondary planes are determined. If these values are outside of given tolerance ranges, then for each individual main journal first the guideline dimension ΔSn is computed, by which a straightening must be performed in the secondary plane. The crankshaft is then straightened in the secondary planes, and all or several corrections are done either simultaneously or successively. The straightening operations are preferably performed in a plurality of successive steps, while after each step the residual deviations are measured and the following step is performed with corrected straightening parameters. The term, "corrected straightening parameters," used herein, is to be understood especially to mean that the magnitude of the force that is needed to achieve the remaining correction dimension ΔSn will vary according to the previous history of the crankshaft and above all according to what forces have been exerted on the main journals in previous steps. In particular, if a certain straightening force in a first step has not sufficed to achieve the desired correction, a greater straightening force is selected in a subsequent step. If the straightening parameters applied in the previous straightening operations are disregarded, a rational straightening will hardly be possible on account of the varying relationships between the straightening dimension and the straightening force. The relationships between the achievable straightening dimensions and the applied straightening forces must be determined empirically.

The data obtained in each case can be assembled and stored in a data base which can serve on a statistical basis as a table of the straightening forces to be applied in each case. In computing the straightening forces, therefore, it is preferable to use a data processing system in which all of the data relating to a particular type of workpiece can be stored.

If all of the components of the deviation from true running that lie in the secondary planes are corrected to such an extent that the remaining deviations lie within the required tolerances, the workpiece is straightened in the principal planes by calculating in like manner the correction dimensions ΔSh in the principal plane and determining the correcting forces on the basis of data determined empirically or drawn from the data base. These straightening operations in the principal plane are performed preferably successively in a plurality of successive steps, until finally the residual deviations of all main journals are within the established tolerances.

The invention sets out finally from the knowledge that straightening can be performed by cold rolling and therefore by means of pressure rollers inserted into the fillets of the main journals 2, by using the pressure rollers to apply a sufficient pressure on selected circumferential sections of the walls adjoining the fillets. For this purpose the crankshaft is rotated continuously or with an oscillatory movement, or the pressure roller is moved around the crankshaft or its theoretical axis in a continuous or oscillatory movement. It is necessary only to vary those forces which are exerted on the crankshaft by the pressure rollers according to the rotational angular position of the crankshaft with respect to the pressure roller, such that a straightening effect will be achieved only in the necessary direction, i.e., by running the pressure rollers against the preselected sections, while in all other directions no forces sufficient for the achievement of a straightening action are exercised by the pressure rollers.

Lastly, the invention sets out also from the knowledge that straightening can be performed by cold rolling and therefrom by means, for example, of pressure rollers laid into the fillets of the main journals 2 by applying sufficient pressure to selected sections of the circumference of the walls adjoining the fillets. For this purpose the crankshaft is rotated continuously or with an oscillatory movement, or the pressure roller in question is moved around the crankshaft and its theoretical axis in a continuous or oscillatory movement. It is necessary only to vary the forces that are exercised by the pressure rollers on the crankshaft according to the angular rotational position of the crankshaft with respect to the pressure roller such that a straightening action is achieved only in the required direction, i.e., when the pressure rollers run onto the previously selected sections, while in all other directions no forces are exercised by the pressure rollers that is sufficient for the achievement of a straightening action.

The apparatus, known in themselves, are preferentially suitable for the practical performance of straightening crankshafts by cold rolling (DE-PS No. 30 37 688), provided that certain alterations are made therein. An apparatus of this kind suitable for the purpose of the invention will be further explained below with the aid of FIGS. 2 to 6 and of a workpiece 1 which consists of a crankshaft with only two crankpins 4*a* and 4*b* and three main journals 2*a*, 2*b* and 2*c*.

Figure 2:
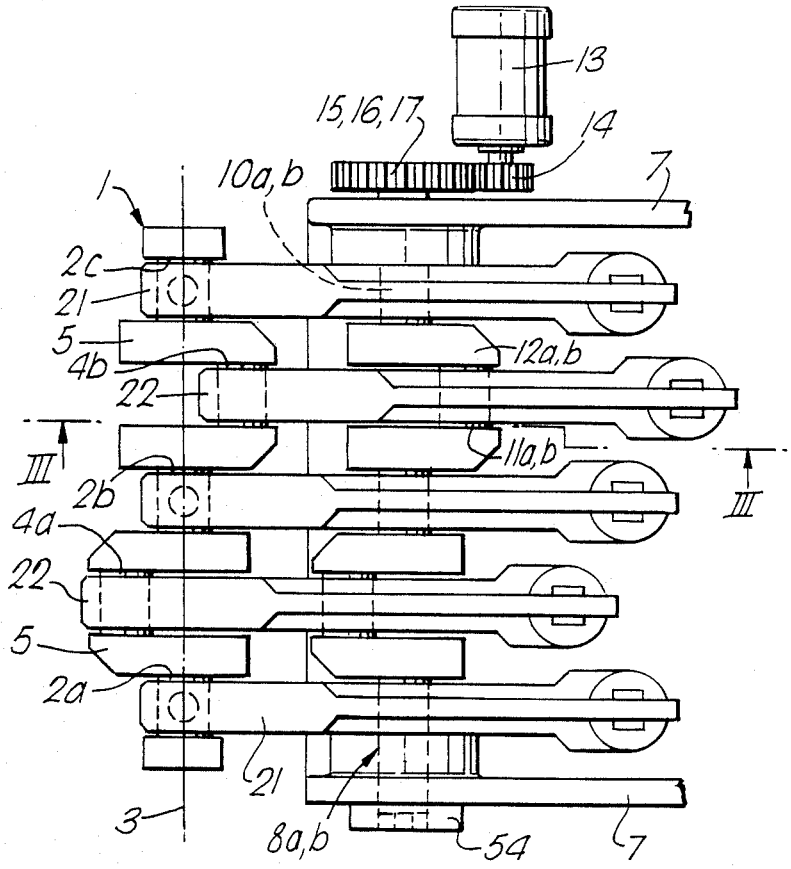
FIG. 2 is a plan view of an apparatus according to the invention for straightening workpieces, especially crankshafts.
Figure 3:
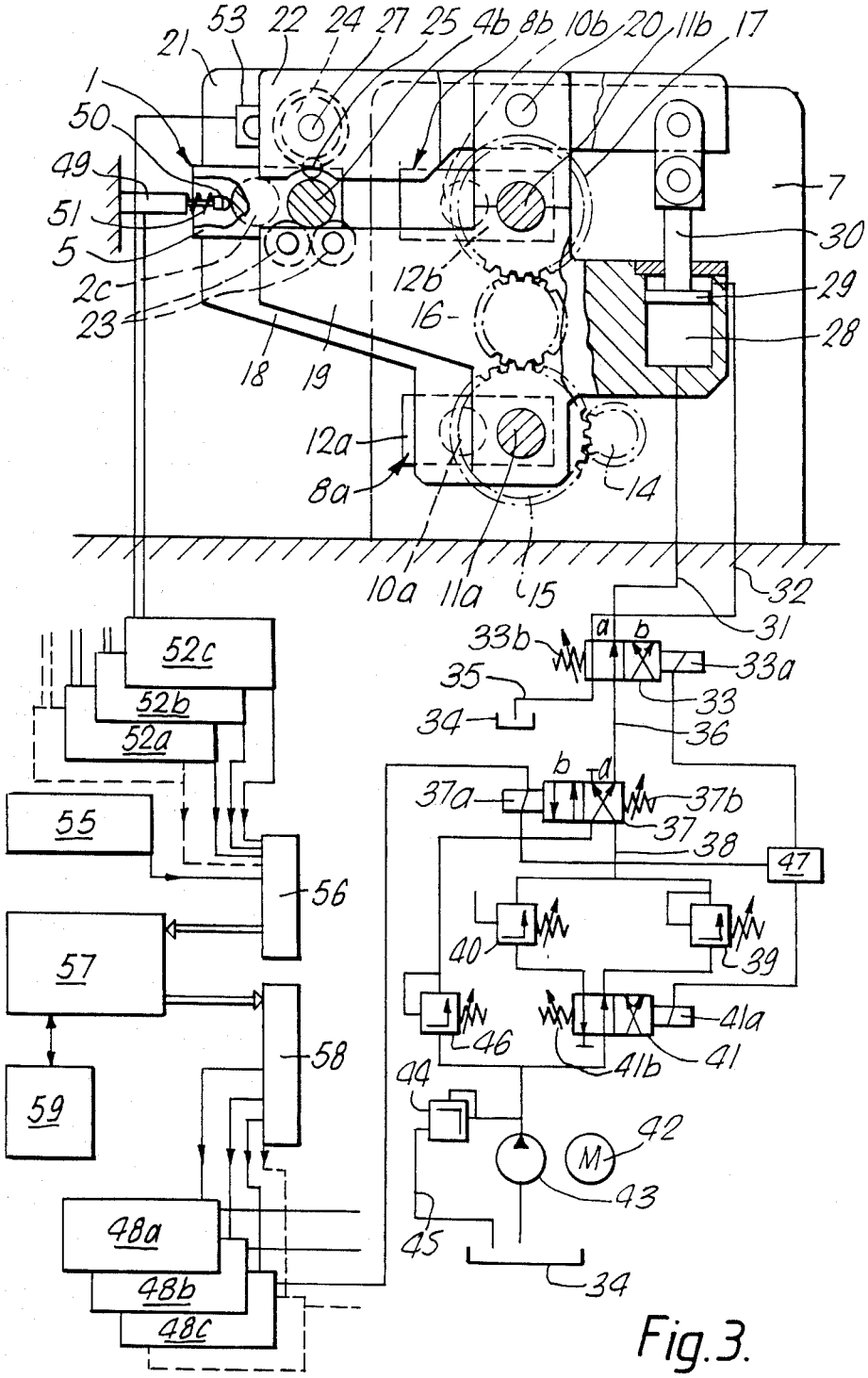
FIG. 3 is a cross section along line III—III of FIG. 2.

The apparatus contains, according to FIGS. 2 to 4, two master shafts 8*a* and 8*b* identical in size and shape to the workpiece 1 being machined, which in the example represented have the same number of main journals 10*a* and 10*b*, crankpins 11*a* and 11*b* and cranks 12*a* and 12*b*. Both master shafts 8*a* and 8*b* can be driven synchronously by a motor 13 mounted on the frame 7, the motor having a gear 14 on its shaft. The gear 14 meshes with a gear 15 fastened on the master shaft 8*a*, which is connected by an additional gear 16 to a gear 17 fastened on the master shaft 8*b*, so that, when the motor 13 is turned on, both master shafts are driven in the same direction.

Each main journal 10 and crankpin 11 is journaled in a lower jaw 18 and 19, respectively, of a pincer-like mounting for the workpiece 1. Each jaw 18 and 19 is pivotally joined by means of a pivot pin 20 (FIG. 2) to an upper jaw 21 and 22, respectively, of the mounting. On their front end the two jaws 18–21 and 19–22 each bear a rolling tool. This rolling tool has two cylindrical and parallel supporting rollers 23 journaled in each of the lower jaws 18 and 19 and a combination, known in itself, of an especially shaped roller 24 and two pressure wheels or hard-rolling wheels 25 (cf. FIGS. 3 and 4). The axes of rotation of the pressure wheels 25 form with the axis 3 of the workpiece 1 or with the axes of rotation of the especially shaped rollers 24 an angle, as a rule, of about 35°. Moreover, the pressure wheels 25 bear against the circumferential grooves 26 which have a circular cross section and are formed on the sides of the especially shaped rollers 24. The roller 24 is journaled on a shaft 27 fastened in the frame 7, while the hard-rolling wheels 25 are mounted in cages running loosely on the rollers 24.

Each pincer-like mounting is associated with a control system, but only the control system for the mounting of main journal 2*c* is represented in FIG. 3. For the sake of simplicity of representation, the rolling tool consisting of parts 23 to 25 for the mounting of the main journal 2*c* is visible only in FIG. 4, but not in FIG. 3. The control system contains a hydraulic or pneumatic cylinder 28 fastened to the rear end of each corresponding lower jaw 18, and in it a piston 29 is slidingly mounted and bears a connecting rod 30 articulated to the upper jaw 21, so that the upper jaw 21 can be rotated about the pivot pin 20 by the extension and retraction of the connecting rod 30. The chambers of cylinder 28 which are situated on either side of the piston 29 can be connected by lines 21 and 32 and a control valve 33 selectively to a line 35 leading to a tank 34 or to an additional line 36. Line 36 leads to one output of an actuator 37, e.g., of an additional control valve which is designed simultaneously as a pressure control valve, and a second, plugged outlet. A line 38 connected to the one input of the actuator 37 is connected either through a limiting valve 39 to the one output or through an additional limiting valve 40 to the other output of an additional control valve 41 whose one input is plugged and whose other input is connected to the output of a pump 43 driven by a motor 42, for the hydraulic or pneumatic medium, e.g., oil. The discharge of this pump 43 is furthermore connected to a limiting valve 44 which is connected by a line 45 to the tank 34. Finally, the discharge of pump 43 is also connected through a limiting valve 46 to the other input of the actuator 37.

The control valves 33 and 42 are provided, for example, with conventional operating magnets 33*a* and 41*a*, while the actuator 37 is associated with a control 37*a* which can also consist of an operating magnet. The operating magnets 33*a* and 41*a* and the controller 37*a* are connected with a program control 47 and the controller 37*a* also leads to the output of a power amplifier 48*c*. Also, each control valve 33 and 41 can assume two positions a and b, position a being the basic position produced by a compression spring 33*b*, 41*b*, while the other position b is produced when the corresponding operating magnet 33*a* or 41*a* is energized by the program control 47. The actuator 37 can also assume two positions a and b, position b being produced by feeding an operating signal to the controller 37*a* by the program control 47 or from the corresponding power amplifier 48c, while the other position, a, is the basic position established by a compression spring 37b. Furthermore, the actuator 37 can be operated by a similar signal from the corresponding power amplifier 48c such that it will assume any desired intermediate position between the two positions a and b in which the pressure at its only open output assumes a value that depends on the pressures at its two inputs and also on the proportions in which the passages indicated by arrows participate in the admission of the pressure medium. Instead of the control valve represented, any other components can be used for the actuator 37 by means of which, under the control of electrical signals or the like, the pressure in line 36 can be steplessly varied between a minimum and a maximum value. For the measurement of the wobble or bending of the workpiece 1, the control system has a measuring means 49 fastened to the frame 7 (FIG. 3). The measuring means 49 consists, for example, of a commercial linear measuring means having a plunger 50 which is urged by a compression spring 51 against the main journal 2c. According to the position of this plunger, an electrical signal appears at the output of the measuring means 49 and is fed to an amplifier 52c associated with the main journal 2c. Alternatively, purely inductive, contactless linear measuring means can be used in order to measure the departures of the main journal from true running. Furthermore, for the control of the forces which are exerted by the upper jaw 21 on the corresponding pressure wheel 25 and on the workpiece 1, a dynamometer 53 can be provided, which consists, for example, of a strain gauge connected with the jaw 21 and provides an electrical signal at its output which is also fed to the measuring amplifier 52c.

The control systems for the other main journals 2a and 2b are of the same construction and provided with the same kinds of measuring amplifiers 52a and 52b and power amplifiers 48a and 48b (FIG. 3). Other similarly constructed control systems can be associated with the mountings for the crankpins 4a and 4b, although only the parts needed for hard-rolling need to be provided, not those needed for straightening.

For the measurement of the angular position of the master shafts 8a and 8b, at least one of these shafts is connected with an indicator means 54 (FIG. 2), e.g., a selsyn transmitter, which can consist of a conventional angle coder and whose output signals are fed to an amplifier 55. The signals put out by the measuring amplifiers 52 and by the amplifier 55 are fed through a wiring harness 56 to a data processing apparatus 57 and from there they are fed through another wiring harness 58 to the power amplifiers 48a, b and c. A data storage device 59, not represented in detail, can be associated with the computer 57.

The apparatus described operates as follows:

In a first step, the workpiece 1, i.e., the crankshaft represented in FIGS. 1 to 4, can be subjected, for example, to a conventional hard-rolling process. Starting out from the basic positions a, the control valves 33 and 41 and the actuator 37 according to FIG. 3, are at first changed to position b by means of the program control 47, which is provided with switches for the purpose or can be operated automatically, by energizing the corresponding operating magnets accordingly. This connects lines 31 to the tank 34 and lines 32 to the lines 36 which lead through the actuators 37 and the limiting valves 46 to the pump 43. When the motor 42 is turned on, therefore, the connecting rods 30 are withdrawn into the cylinders 28 thereby opening the pincer-like mountings.

The crankshaft that is to be straightened is now laid in the mounting by placing its main journals 2 and crankpins 4 on the supporting rolls 23 of the corresponding lower jaws 18 and 19, which is easily done on account of the matching shape of the master shafts 8a and 8b (cf. especially FIG. 2). Then the control valves 33 are returned to the basic position a by de-energizing the corresponding operating magnets and at the same time the actuators 37 are brought to position b by the program control 47. This connects lines 32 to the tank 43 and lines 31 to the pump 43 through the limiting valves 39. When the motor 42 is turned on, therefore, the connecting rods 30 are extended and the pincer-like mountings are closed with a pressure established by the limiting valves 39. By turning on the motor 13, the two master shafts 8a and 8b are now set in rotation and thus the jaws 19 and 22 on their crankpins 11a and 11b are set in a circular movement which is transferred accordingly to the crankpins 4a and 4b of the crankshaft being straightened. This brings the result that the pressure rollers 25 roll in the fillets of the crankpins 4a and 4b and of the main journals 2a, 2b and 2c and produce the desired hard-rolling. The force with which the pressure rollers 25 exert on the walls of the fillets can be adjusted manually or automatically by means of the limiting valves 39.

After the hard-rolling has ended the motor 13 is shut off and the pincer-like mountings are reopened by the appropriate operation. The crankshaft can now be removed and measured in any desired manner known in itself for the purpose of determining the deviations present after the hard-rolling process, the corrections ΔSn and ΔSh, and the required straightening forces.

The measurement of the workpiece 1 is preferably performed, when the apparatus described is used, by leaving it clamped in the pincer-like mountings and sensing it with the measuring means 49. To prevent the pressure rollers 25 from exerting any great force at this time, the valves 33 and 41 are left in the basic position a while the actuator 37 is shifted by the program control 47 to position b. Thus the line 41 is now connected through the limiting valve 46 to the pump 43 which is set at a lower pressure than the limiting valve 39. After the motor 13 is again turned on, the crankshaft being worked on resumes its characteristic rotating movement. At the same time the measuring means 49 are activated so that the signals measured thereby are fed through the measuring amplifier 52 and the wiring harness 56 to the data processing apparatus to which the output signals from the indicator means 54 are also constantly fed. The data processor 57 now determines, on the basis of a previously input program, and of the data constantly fed to it by the measuring means 49 and the indicator means 54, the magnitude and direction of the deviations from true running of all main journals 2a, 2b and 2c and then computes the correction magnitudes ΔSn and ΔSh, as well as the streightening forces to be exerted by the pressure rollers 25 on the main journals 2a, 2b, 2c, while all of the data stored in the data base 59 and relating to similar types of workpiece can be taken into consideration. Finally the data processor 57 converts the determined straightening forces into analog signals for operating the control means 37a of the actuators 37.

Then follows the actual straightening process. For this purpose the crankshaft in question remains in the pincer-like mountings, while the control valves 33 and the actuators 37 are set to their basic position a. The control valve 41, however, is changed to position b.

By turning on the motors 13 and 42, the crankshaft in question is again made to perform its characteristic rotatory movement, while at the same time the lines 31 are first connected to the pump 43 only through the limiting valves 46. Under the control of the indicator means 54, which constantly rotates with the master shafts, the data processor continues to run and constantly deliver operating signals which are fed through wiring harness 58 and the power amplifiers 48*a*, 48*b* and 48*c* to the actuators 37*a*. Consequently their valve shafts are displaced more or less in the direction of positions b depending on the computed straightening forces, with the result that pressures are produced in the lines 36 which can be between the minimum of the limiting valve 46 and the maximum of the limiting valve 40. By means of the indicator means 54 and the data processing apparatus, there are also so operated that at first only straightening operation in the secondary planes are performed on all main journals. Preferably these straightening operations are performed for several or all main journals simultaneously or successively and, as described above, in several successive steps between which the crankshaft is remeasured so that the data obtained can be stored in the data base 59 and then new straightening parameters can be computed for the next step. After the straightening operations in the secondary planes have been concluded and intolerable deviations from true running are still present only in the main plane, additional straightening operations are performed in the same manner in order to make the deviations from true running present in the principal plane sufficiently small. This results in the advantage that the direction in which a straightening operation is performed on any main journal can be preselected by the mere fact that the corresponding actuators 37 make sufficiently great pressures available in lines 36 at the correct moment, while at all other times the pressure in lines 36 is lowered to one which cannot perform any straightening operation. Since furthermore each individual main journal 2*a*, 2*b*, 2*c* is provided with its own mounting and its own control system, the different straightening operations can be performed in a single procedure even if all main journals are associated with different principal and secondary planes.

In all possible working situations, finally, the maximum system pressure is represented by the limiting valve 44, so as to prevent critical overpressures from occurring. Furthermore, it is possible by means of the dynamometer 53 to maintain a constant watch over the forces actually exerted on the pressure rollers 25 and, in case of necessity, to provide control circuits for the cylinders 28 so that the straightening forces computed by the data processor 57 will actually be exerted on the workpieces 1 and main journals 2.

If it is not desired to use a data processor the pressures fed to the cylinders 28 during the straightening can also be produced by controlling each actuator 37 with a system represented diagrammatically in FIG. 5. This system contains, instead of the actuating magnets, a tube 60 connected to the valve stem of the actuator 37, in which a plunger 61 is displaceably guided. The tube 60 has an upright arm 62 and the plunger 61 has an upright arm 63 extending through a slot in the tube wall. An adjusting screw 64 is journaled in the arm 63 but is axially fixed, and its threaded section extends through a threaded bore in the arm 62. Therefore, by turning the adjusting screw the distance between the valve stem and the extremity 65 of the plunger 61 extending from the tube 60 can be varied. The free end of the plunger 61 is urged by a compression spring 37*b* acting on the valve stem, against the actuator means in the form of a cam 67 which is fastened, for example, to one fee end of the master shaft 8*a* and accompanies its rotatory movements. Depending on which section of the circumference of the cam 67 acts on the extremity 65, a greater or lesser force is exerted on the pressure roller 25 as in the case of the embodiment described in conjunction with FIG. 3. The cam 67 is fastened to the master shaft 8*a* by means of a screw 68 and then assumes always the same angular position relative to the master shaft and hence also to be crankshaft being straightened. At the same time, different cams 67 are used according to the forces required for straightening in the secondary and primary planes, which are furthermore adjusted precisely by rotation on the shaft 8*a* according to the directions in which the straightening forces are to be applied. It is possible by turning the adjusting screws 64 to vary the magnitude of the maximum straightening force in each case.

For the straightening of any main journal 2 diagrammatically represented in FIG. 6, it would be necessary basically only to exert the straightening force only once along an imaginary line running parallel to the theoretical axis 3 on the circumference of the main journal 2, this line lying in the prolongation of an arrow v indicating the direction of the straightening operation. The straightening forces to be exerted in that case would however be very great. In straightening by cold rolling, however, it has surprisingly been found that substantially lower straightening forces of, for example, up to 50 kN suffice if they are applied along a selected section 69 which is indicated in FIG. 6 by a thicker line, and if this selected section 69 is rolled repeatedly with the pressure roller 25. The section 69 extends long the circumference of the main journal 2 approximately equally on both sides of the imaginary line, over an arc totaling, for example, 10° to 20°. To prevent indentations in the main journal 2 by the pressure roller 25, it is best to increase the pressure acting on the cylinder 28 gradually to a maximum before the pressure roller 25 starts onto the selected section 69, then to hold it at this maximum all along the section 69, and finally, after it leaves the section 69, gradually to reduce it. If the data processing system 57 is used, this increasing and decreasing of the pressure can be established by appropriate programming. If the cam 67 is used according to FIG. 5, this method is practiced by providing the cam's circumference with an approximately circular section 70, a rising section 71, another circular section 72, and a descending section 73, section 72 corresponding to the section of the main journal 2 along which the pressure roller 25 exerts the streightening force required for the straightening operation. If it is desired, in this type of control, to reduce the time necessary for one rotation of the crankshaft, it is necessary only to set the motor 13 at a higher step of rotatory speed whenever the pressure roller 25 is not only the selected section 69.

Alternatively, the straightening operation can also be performed by subjecting the master shafts 8*a* and 8*b* and the crankshaft being straightened to a back-and-forth rocking movement such that the pressure rollers 25 always run only over the preselected sections 69 and narrow adjacent sections. In this case too, the pressure acting on the pressure rollers is best gradually increased and decreased in the adjacent areas. In this embodiment, too, the data processing apparatus 57 or the cams 67 can be used alternatively. The motor 13 in this case is best a reversing motor with an appropriate controller.

Another important parameter in straightening by cold rolling is the number of times the selected sections 69 are rolled over. Since in the case of rolling, i.e., of the action of the pressure rollers 25 on the selected sections 69, flow toward the bottoms of the fillets 6 can become impeded, which can be compensated only by repeated rolling, the pressure rollers are best run at least five times, preferably at least ten times over the selected section 69.

The invention is not limited to the embodiments described, which can be modified in many ways. This is the case, for example, with the control systems, actuators and organs of control, measurement and display. In particular, neither is it necessary, though it may be expedient, to use the apparatus described both for hard-rolling and for measuring and straightening the workpieces 1. Alternatively it would be possible to perform especially the measurement of the crankshafts outside of the apparatus and to provide two apparatus for the hard-rolling and straightening, one of which is used exclusively for hard-rolling and the other exclusively for straightening.

I claim:

1. A method of rolling for hardening and straightening purposes a crankshaft or the like having a theoretical axis, a plurality of main journals and crankpins, crankwebs joining the crankpins and the main journals and fillets having walls, running about said axis and being disposed at transitions between the crankwebs and the main journals or crankpins, respectively, comprising the steps of: hardening said crankshaft by rolling the fillets of all main journals and crankpins by laying tools into the fillets and moving said tools transversely of said axis for exerting pressure on said walls, then measuring the true running of the crankshaft by means of measuring deviations of the main journals of the true running and then straightening said crankshaft by again rolling the fillets of a plurality or all main journals in dependence on said measured deviations in a manner to reduce them by again laying tools into the fillets and moving said tools transversely of said axis for exerting pressure on at least preselected sections of said walls.

2. Method according to claim 1 for hardening and straightening crankshafts having a plurality of main journals and crankpins, in which the axis of the crankpins all lie on a single main plane containing also the theoretical axis, wherein after said hardening and measuring steps the crankshaft is straightened first in a secondary plane running perpendicular to said main plane and also containing said theoretical axis and then in the main plane.

3. Method according to claim 1 for hardening and straightening crankshafts having a plurality of main journals and crankpins, wherein the axes of the crankpins do not all lie in a single plane containing the theoretical axis and wherein one or two crankpins are adjacent each main journal, comprising the steps of defining for each main journal a main plane and a secondary plane, said main plane either containing said theoretical axis and the axis of said one adjacent crankpin or containing said theoretical axis and the angle bisector between two planes which contain the theoretical axis and the axis of one of said adjacent crankpins, and said secondary plane being perpendicular to said main planes; and of straightening after said hardening and measuring steps of the crankshaft by first straightening it in the secondary planes and thereafter in the main planes.

4. method according to one of claims 1, 2 or 3 wherein the straightening is performed in successive steps, wherein the crankshaft is remeasured after each step for again measuring said deviations after each step and for obtaining corrected straightening parameters thereof, and wherein following steps are performed in dependence on said corrected parameters.

5. Method according to claim 1, wherein the straightening is performed with at least one pressure roller (25), during the rolling a relatively rotary movement is produced between the crankshaft (1) and the pressure roller (25) about the axis (3) and at least a force producing the straightening process is exerted on the pressure roller (25) whenever the latter runs over a preselected section (69) of a fillet wall.

6. Method according to claim 5, wherein the crankshaft (1) or the pressure roller (25) is subjected to a continuously revolving rotatory movement.

7. Method according to claim 5, wherein the force exerted on the pressure roller (25) is gradually increased each time before it runs onto the selected section up to a maximum, then is held at this maximum, and finally, before leaving this section (69), is gradually reduced.

8. Method according to claim 5, wherein the preselected section (69) is treated up to ten times with the pressure roller (25).

9. Apparatus for straightening crankshafts having a plurality of main journals and crankpins having fillets comprising: two master shafts; means for rotating said shafts; a plurality of pincer-like mountings supported by said shafts for clamping said main journals and crankpins, each mounting being associated to one of said main journals and crankpins, and at least said mountings associated with said main journals having two jaws, joined together pivotally, one of said jaws being provided with at least one supporting roller and the other one of said jaws being provided with at least one pressure roller intended for insertion into a fillet; means for pivoting said jaws for exerting pressure by said pressure rollers onto said fillets; at least one indicator means indicating the particular rotary angle position of the crankshaft during rotation of said master shafts; measuring means for determining deviations from true running in the area of all of the main journals; and actuator means for pivoting said jaws of each of said mountings associated with said main journals such that the pressures exerted by the pressure rollers thereof onto the fillets of the main journals are adjusted in a manner to reduce said deviations and in dependence on the particular rotary angle position of the crankshaft and on the particular deviations of the respective main journals.

10. Apparatus according to claim 9, wherein controlling means are coupled with said actuator means for automatically controlling the pressure exerted by said pressure rollers.

11. Apparatus according to claim 10, wherein said pivoting means, said measuring means, said indicator means and said actuator means are coupled to and controlled by a data processing system.

* * * * *